United States Patent [19]

Hunt et al.

[11] 4,435,703

[45] Mar. 6, 1984

[54] APPARATUS AND METHOD FOR SIMULTANEOUS DISPLAY OF CHARACTERS OF VARIABLE SIZE AND DENSITY

[75] Inventors: Glenn E. Hunt; Michael C. Alexander; Gerald L. Lozano; Gerald O. Manktelow, all of Austin, Tex.

[73] Assignee: Data General Corporation, Westboro, Mass.

[21] Appl. No.: 280,613

[22] Filed: Jul. 6, 1981

[51] Int. Cl.[3] ..... G09G 1/16

[52] U.S. Cl. ..... 340/723; 340/744; 340/749; 340/731

[58] Field of Search ..... 340/744, 748, 749, 750, 340/723, 731

[56] References Cited

U.S. PATENT DOCUMENTS

| | | | |
|---|---|---|---|
| 3,896,428 | 7/1975 | Williams | 340/731 |
| 3,903,517 | 9/1975 | Hafner | 340/731 |
| 3,999,168 | 12/1976 | Findley et al. | 340/731 |

*Primary Examiner*—Marshall M. Curtis

*Attorney, Agent, or Firm*—Robert L. Dulaney

[57] ABSTRACT

Apparatus and method for simultaneous display of alphanumeric characters of variable character density on a raster scan CRT monitor is disclosed. Circuitry is provided to supply multiple sources of timing for terminal operations, to switch among timing sources without display degradation, and to vary the number of dots per raster line that constitute a character field. The density of displayed characters may be changed, under user control, for each character row.

3 Claims, 16 Drawing Figures

FIG 8 VIDEO CONTROL

APPARATUS AND METHOD FOR SIMULTANEOUS DISPLAY OF CHARACTERS OF VARIABLE SIZE AND DENSITY

CROSS REFERENCE TO RELATED APPLICATIONS

The present application is related to copending U.S. applications Ser. No. 280,612 and Ser. No. 280,619. All three applications were filed July 6, 1981 and are assigned to Data General Corporation.

BACKGROUND OF THE INVENTION

1. Field of the Invention

The present invention relates generally to cathode ray tube (CRT) displays and particularly to apparatus and methodology for generating and displaying alphanumeric characters of selectable size and density.

2. Description of the Prior Art

The image on a CRT is generated by using an electron beam to stimulate selected areas of a phosphorescent material located on the inside of the CRT screen. The scanning of the CRT face is accomplished by deflecting the electron beam relatively rapidly in one direction, usually horizontal, and relatively slowly in a second direction, usually vertical. The phosphorescent material on the screen is continuous, but the screen can be considered to consist of a large number of generally horizontal, parallel "raster lines" or lines of displayed information. As the beam scans along a raster line, the information about the level of stimulation to be given a particular area on the raster line is updated at fixed intervals in accordance with a clock pulse or "dot clock". Therefore, each raster line can be further considered to be a series of discrete segments or "dots" which are individually stimulatable by the electron beam.

The electron beam normally performs 50 or 60 "frames" or complete scans of the CRT screen per second, depending on the external electrical power available. From the viewpoint of an observer facing the screen, the beam begins a frame at the left side of the top raster line of the CRT and moves substantially horizontally along the line to the right side of the screen stimulating each dot to the appropriate level to create the desired image. The beam then performs a horizontal retrace to the left side of the next lower raster line and again begins to scan horizontally to the right. This continues until the beam reaches the right side of the lowest raster line, at which time a vertical retrace is performed during which the beam moves back to the beginning of the top raster line to begin the next frame. No information is displayed during either horizontal or vertical retrace.

Characters displayed on the screen are formed by an arrangement of dots. A character area 7 dots wide and 9 dots (i.e. 9 scan lines) high is adequate to allow display of all common alphanumeric characters. The specific character desired is created by stimulating the appropriate pattern of dots within the 7×9 dot character area. To ensure adequate horizontal spacing between adjacent characters in a line or "row" of text and vertical spacing between the rows, the character area is typically considered to be part of a character field, generally 10 dots wide by 12 scan lines high. The size of the character field and the characteristics of the terminal determine the amount of information that can be displayed on the monitor. If the terminal, for example, displays 1000 discrete dots per scan line, then, at 10 dots per character, up to 100 characters can be shown on a horizontal row. Similarly, if the terminal performs, for example, 240 horizontal scans during each vertical scan, then, at 12 scan lines per character row 20 rows of character information can be shown.

Some prior art terminals are capable of displaying more than one dot density, but in these terminals only one density may be used during any one frame. That is, during a given frame, every raster line of the display will have exactly the same number of dots and therefore the same number of character fields per line. This substantially limits the ability of the CRT user to display his text on the screen. Another problem in the prior art is the extremely high work load of the CPU which can result from user changes to the display. In the prior art, data to be displayed is commonly stored in sequential memory locations in terminal memory. The first character to be displayed (i.e. the leftmost character of the top row) is not necessarily located in the first memory location and is typically indicated by a "top of page" pointer. The leftmost character of displayed row 2 is stored in the memory location immediately following the rightmost character of row 1, and so on, with the rightmost character of the last row being the end of the "string". If, for example, a character is to be inserted into the display and therefore inserted into the "string" of characters sequentially stored in memory, the addresses of all characters following the insertion must be changed to reflect their new position in the string. If the insertion occurs near the top of the screen, a substantial amount of processor work must be performed to change the memory locations of all following characters. To complete the operation during vertical retrace requires the terminal to have a very fast CPU and memory. To allow the operation to continue over multiple frames presents the terminal user with a visible "ripple" effect as the memory is updated.

A related prior art problem is the high processor workload resulting from the method of performing vertical or horizontal scrolling. To avoid display degradation or delays, prior art terminals which provide scrolling capability must use a processor capable of performing the data movements required under the prior art method.

Yet another prior art problem is the requirement to generate the dot information for a character field that is, typically, 10 dots wide. "Standard" ROM's (read only memories) are unavailable with 10 outputs and, while the actual character will occupy only a subset of the field, typically 7 dots, the remaining dots cannot always be blanked because of other terminal requirements such as the occasional need to display a solid horizontal line across part or all of the screen. Prior art terminals, therefore, have generally been required to use either a "custom" 10-bit ROM or an 8-bit ROM in conjunction with a 4-bit ROM. Either alternative adds to the cost of the terminal.

The present invention relates to a novel circuit and method for resolving the above prior art problems.

SUMMARY OF THE INVENTION

The present invention relates to apparatus and method for simultaneous display on an alphanumeric CRT terminal of character rows having variable character size and density. A circuit for implementing the present invention includes apparatus for providing a first dot clock signal, apparatus for providing a second dot clock signal having a different frequency than the first signal and apparatus for selecting one of the two dot clock signals to be used by the terminal for displaying alphanumeric characters.

It is a feature of the present invention that the first dot clock signal frequency and the second dot clock signal frequency are integer multiples of the horizontal scan frequency of the terminal.

It is a feature of the circuit for implementing the present invention that a master clock and circuitry for dividing the signal from the master clock to obtain the first dot clock signal and the second dot clock signal are included.

It is a feature of the circuit for implementing the present invention that apparatus is included for generating a character clock.

It is a feature of the present invention that the dot clock selected may change with each character row.

Other features and advantages of the present invention will be understood by those of ordinary skill in the art after referring to the detailed description of the preferred embodiment and drawings herein.

DESCRIPTION OF THE PREFERRED EMBODIMENT

Introduction

Figure 1:
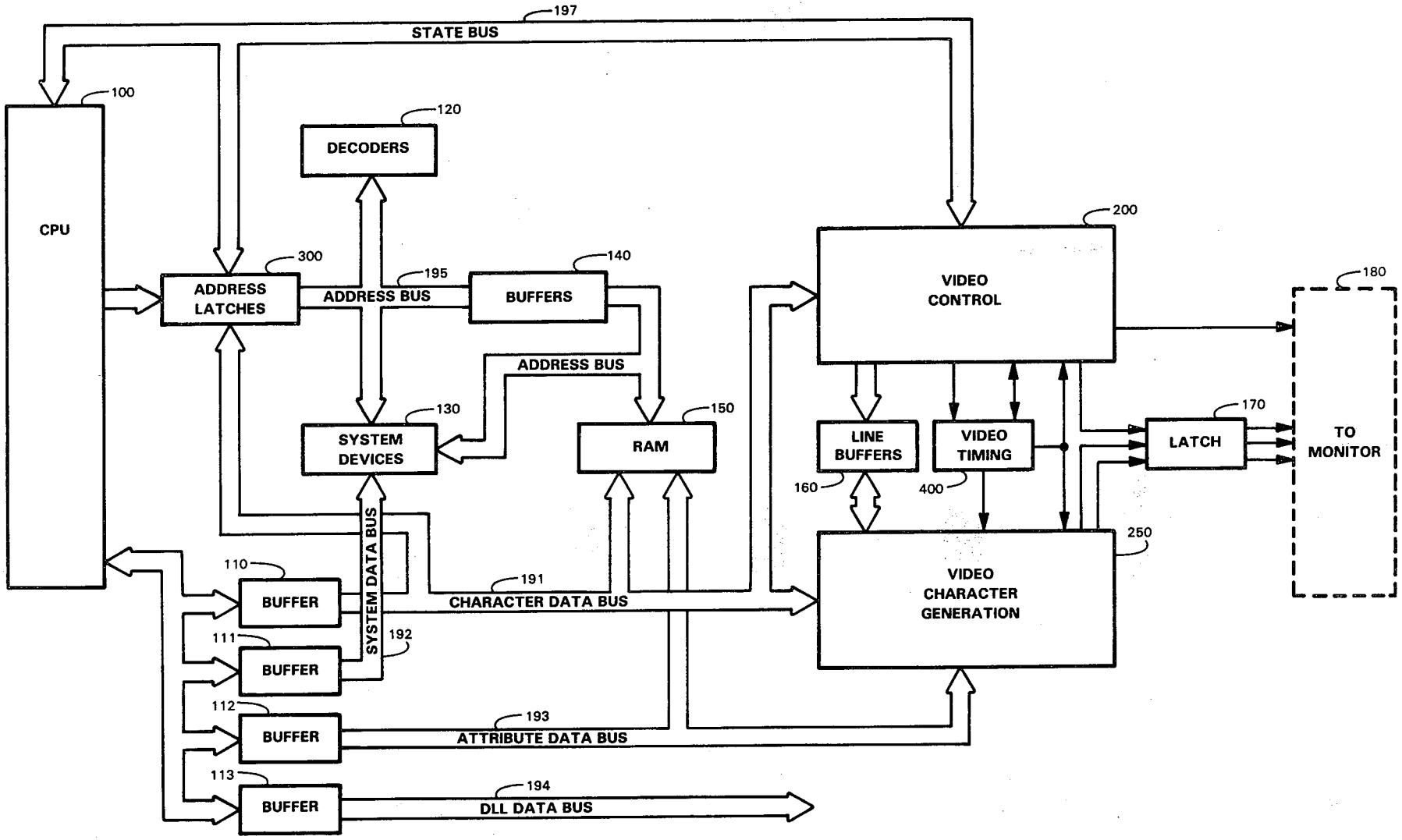
FIG. 1 is a block diagram of a CRT terminal embodying the present invention.

For clarity of presenting and illustrating the invention, a terminal having specific parameters will be used as the basis for discussion, but it should be understood that the invention is not limited to a single specific set of numbers or dimensions. Obviously, many terminal parameters will depend on such factors as CRT size, semiconductor operating limitations and monitor performance characteristics. Therefore, the following discussion will assume a terminal having 288 total displayed scan lines. The displayed scan lines allow 24 displayed horizontal "rows" of characters of 12 scan lines each. Within each row, the displayed character occupies scan lines 2 through 10 (i.e., character height is 9 scan lines). If 22 scan line times occur during vertical retrace while no information is being displayed, the terminal can be viewed as cyclicly performing 310 (288+22) horizontal scans per vertical scan cycle.

To be able to vary the number of characters that can be displayed per row, either the density of the dots on the scan line or the number of dots per character field must be changeable. A preferred embodiment combines both capabilities in a novel manner to allow the terminal user to simultaneously display rows having different character densities. Again for purposes of illustration and ease of discussion, the terminal will be described as having character modes of 81 displayed characters per row and 135 displayed characters per row. Taking into account the time which transpires during horizontal retrace, there are 111 character times per horizontal scan cycle in the 81 column format and 185 character times per horizontal scan cycle in the 135 column format. The 81 column character field is selected to be 10 dots wide and the 135 column character field to be 9 dots wide. The actual displayed character within the field is normally maintained at 7 dots wide in both formats. These numbers are not the only possible choices, but have merely been selected as a preferred embodiment of the invention.

Overview and Interconnection

Referring to FIG. 1 an overview of the internal logic of an intelligent video display terminal is shown. CPU 100 interfaces with Character Data Bus 191 via bidirectional buffer 110, System Data Bus 192 via bidirectional buffer 111, Attribute Data Bus 193 via bidirectional buffer 112 and Downline Loadable Character Bus 194 via bidirectional buffer 113. Buffers 110 and 112 each interface a different address space of RAM (Random Access Memory) 150 to CPU 100. Data are transferred over Character Data Bus 191 to Address Latches 300, RAM 150, Video Control Logic 200 and Video Character Generation Logic 250. Data related to the various system devices with which the terminal may interface (e.g. keyboard, printer) is carried via System Data Bus 192 to and from System Devices Logic 130. Data specifying the attributes (e.g. dim, blink, underscore, inverse) of the characters to be displayed are transferred via Attribute Data Bus 193 to RAM 150 and Video Character Generation Logic 250. Downline Loadable Character Bus 194 allows terminal users to transfer their own unique characters to CPU 100 for display. Address Bus 195 is connected to Address Latches 300, Decoders 120, System Devices Logic 130, Buffers 140 and RAM 150.

Decoder Logic 120 contains logic to decode the information on Address Bus 195 to determine which, if any, system device is being addressed. Buffers 140 provide the appropriate TTL to MOS interface, as required by RAM 150 and some elements of System Devices 130 (e.g. ROM's).

Video Control Logic 200 is connected to CPU 100, Address Latches 300, Buffer 110, Line Buffers 160, Video Timing Logic 400, Latch 170, RAM 150, Video Character Generation Logic 250 and CRT Monitor 180. Video Character Generation Logic 250 is connected to Buffers 110 and 112, Line Buffers 160, Video Timing 400, Latch 170, and RAM 150. CPU 100 is connected via System Device Logic 130 to the host computer (not shown) external to the terminal and communicates with the host over System Data Bus 192.

Figure 2:
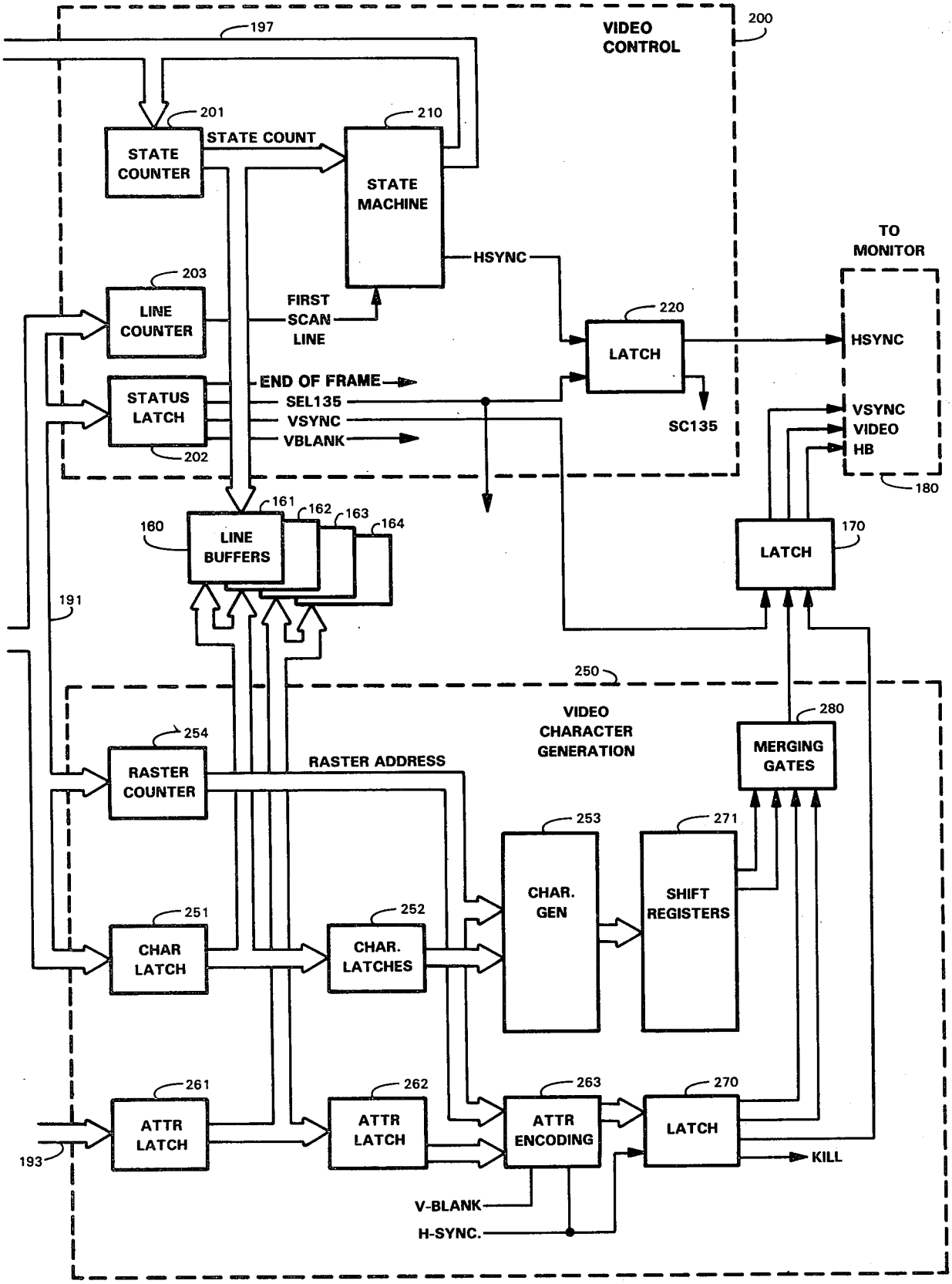
FIG. 2 is a block diagram of the Video Control Logic and Video Character Generation Logic of FIG. 1.

Referring now to FIG. 2, a more detailed schematic of Video Control Logic 200, Line Buffers 160 and Video Character Generation Logic 250 is shown. Video Control Logic 200 generates the horizontal synchronization signal for the monitor drive electronics; provides synchronization between CPU 100 and RAM 150; controls the transfer of information from RAM 150 to Character Generation Logic 250 and Line Buffers 161–164; and prevents access by CPU 100 to RAM 150 during transfers of display information (described below) to Line Counter 203, Raster Counter 254, Status Latch 202, and Line Buffers 161–164. CPU 100 controls Video Control Logic 200 only by means of a discrete halt line, which is used during initial setup of the display information after a hardware restart.

Character Generation Logic 250 receives character and attribute data from data buses 191 and 193 and from Line Buffers 161–164, control information from Video Control Logic 200, and timing signals from Timing Logic 400 (not shown in FIG. 2). Character Generation Logic 250 combines the character, attribute and control information and generates the dot pattern for transmission to monitor 180.

State Counter 201 counts the character time periods during each scan line and provides the character count to State Machine 210. Line Counter 203 receives information from Character Data Bus 191 and notifies State Machine 210 when the first scan line of each character row is being displayed. Status Latch 202, under control of State Machine 210, provides an interrupt signal to State Machine 210, character format information to Latch 220, a vertical sync signal to Latch 170 and a vertical blanking signal to Attribute Encoding Logic 263. State Machine 210 provides control signals to CPU 100, Address Latches 300 and State Counter 201. State Machine 210 also supplies the horizontal synchronization signal to Latch 220.

Character Latch 251 receives character data from bus 191 on the first scan line of each character row. This data is supplied simultaneously to Line Buffers 161 and 162 and Character Latches 252. Similarly Attribute Latch 26 receives attribute data from bus 193 during the first scan line of each character row and supplies it simultaneously to Line Buffers 163 and 164 and Attribute Latch 262. Raster Counter 254, under State Machine 210 control, receives raster address information from bus 191. This information is supplied to Character Generator 253, which also receives the character information from Latches 252. Similarly, Raster Counter 254 is connected to Attribute Encoding Logic 263, as is Attribute Latch 262.

The output of Character Generator 253 is provided to Shift Registers 271. The output of Attribute Encoding Logic 263 is provided to Latch 270, two outputs of which are supplied to Gates 280 where they are combined with the outputs of Shift Registers 271. A third output of Latch 270 is supplied directly to Latch 170 along with the vertical synchronization signal from Status Latch 202 and the output of Gates 280.

Timing

For proper operation, the monitor must receive certain timing signals, such as a dot clock pulse, a character clock pulse, and horizontal and vertical synchronization signals. The horizontal synchronization pulse must remain very stable in both width and periodicity during monitor operations. Variations of as few as ten nanoseconds result in significant degradation in character quality (e.g. wavering vertical lines).

Maintaining a stable horizontal sync pulse is normally no problem in a fixed column width terminal, but in a terminal having multiple dot clock rates and, therefore, being capable of the simultaneous displaying of multiple column widths, such degradation can result unless the dot clock frequencies are carefully selected and the circuitry is specifically designed to ensure constant sync pulses.

As the vertical scan is in progress, the transition from one display column width to another column width can be seen to present a situation where the last scan line of a row is clocked at one frequency while the next scan line (i.e. first scan line of the next row) must be clocked at a different frequency. If the clock frequencies, are not "compatible" some slight foreshortening or lengthening of the horizontal sync pulse will usually result at the transfer of dot clock control from one source frequency to another. This sync pulse variation would, as mentioned, cause unacceptable degradation of displayed characters. The ability to simultaneously display multiple column widths without distortion or degradation of displayed characters is, therefore, dependent on the ability to perform a smooth transfer of control among the dot clock sources (i.e. a transfer which does not disrupt the horizontal synchronization).

To ensure a smooth transfer, the frequencies of the dot clock sources must be such that all clock sources begin and end the horizontal scan period "together". This compatibility can be created by using a single master clock source and performing division operations to yield multiple clock frequencies having a specific ratio to each other.

Figure 4:
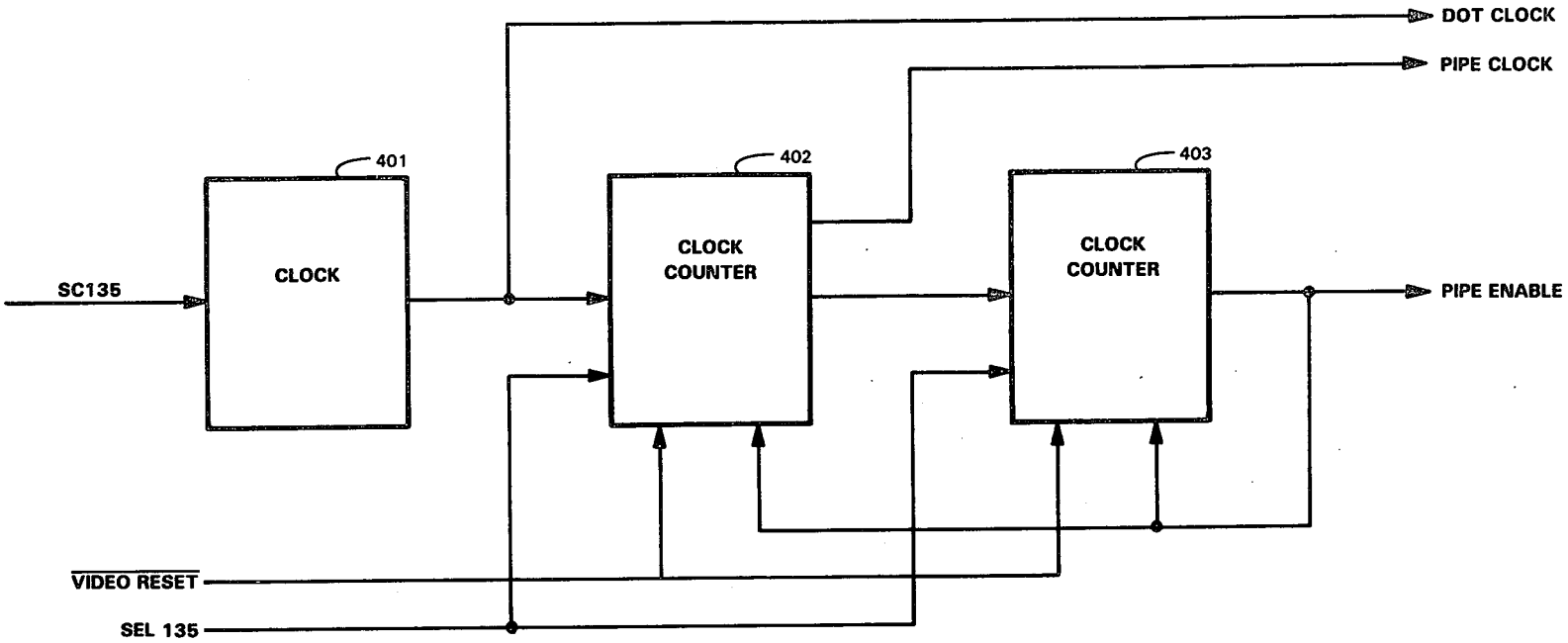
FIG. 4 is a block diagram of the Video Timing Logic of FIG. 1.

Referring now to FIG. 4, an overview of Timing Logic 400 is shown. Signal SC135 controls the source of the Dot Clock pulse. Clock 401 receives signal SC135 from Latch 220 and outputs the appropriate DOT_CLOCK signal. This clock pulse is supplied to Clock Counter 402 and is used for various operations which must occur on a dot time basis. Clock Counter 402 also receives the signals SEL 135 from Status Latch 202, VIDEO_RESET from Video Control Logic 200 and PIPE_ENABLE from Clock Counter 403. One output of Clock Counter 402 is the PIPE_CLOCK pulse. Each PIPE_CLOCK pulse is equal to a character time and is therefore equal to the length of a Dot Clock pulse times the number of dots in the character width, i.e. the number of dots per scan line in the character field. PIPE_CLOCK and PIPE_ENABLE are used for operations which must occur on a character time basis. The second output is provided to Clock Counter 403, as is VIDEO_RESET. Clock Counter 403 outputs PIPE_ENABLE, used to control the loading of registers and counters clocked by PIPE_CLOCK.

Figure 5:
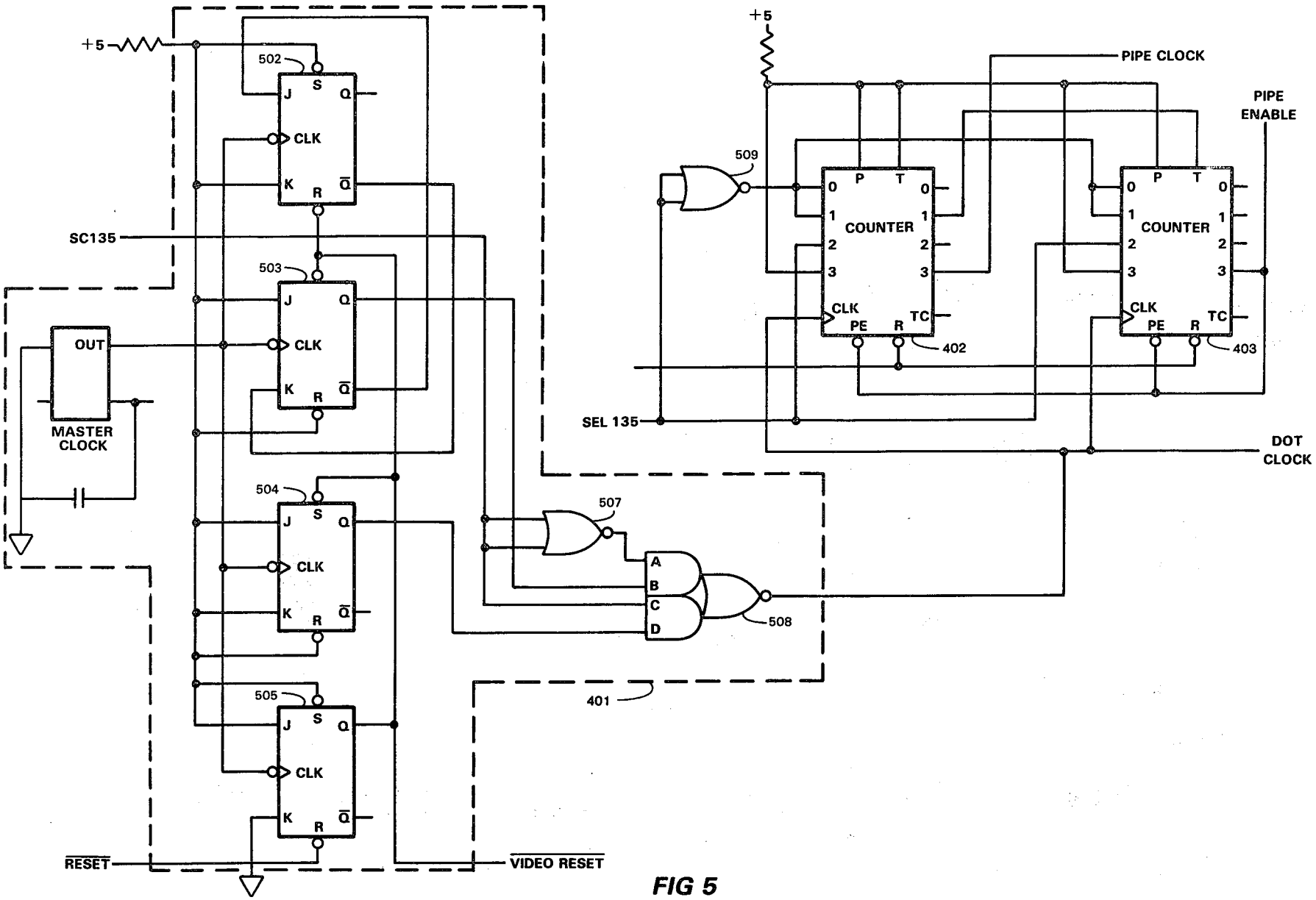
FIG. 5 is a schematic diagram of the preferred embodiment of the Video Timing Logic of FIG. 4.

Referring now to FIG. 5, a detailed schematic of Timing Logic 400 is shown. Master Clock 501 provides a highly accurate source of clock pulses. For example, the K1114A- 61.938 MHz crystal oscillator manufactured by Motorola Components Inc. provides a TTL compatible pulse with an accuracy of plus or minus 0.05%. The falling edge of the pulse from Master Clock 501 clocks flip flops 502, 503, 504 and 505 (for example, 74S112's).

The output of Master Clock 501 is divided by two to create the appropriate Dot Clock rate for display of an 81 character line and by three to create the Dot Clock rate for a 135 character line. The division is performed by flip flops 502 and 503 to achieve the 135 character dot clock rate and by flip flop 504 to achieve the 81 character rate. Flip flop 505 performs reset functions.

Figure 6:
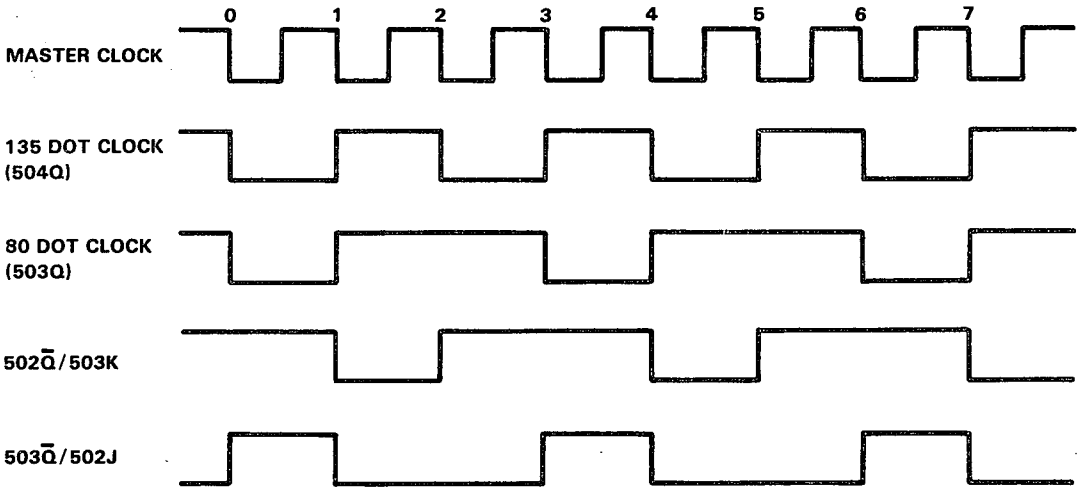
FIG. 6 is a timing diagram illustrating the operation of certain portions of the Video Timing Logic of FIG. 5.

Looking first at the case of generating the dot clock for the 135 character line (i.e., SC135 is high). Input C of gates 508 will be high and input A will be low, having been inverted by gate 507. The output of gates 508 (i.e., DOT_CLOCK) will therefore be controlled by flip flop 504. Flip flop 504 is connected as a toggle, and its Q output will change state every other master clock cycle. Therefore, Dot Clock will be one-half the Master Clock rate, as shown in FIG. 6.

Looking now at the case of generating the dot clock for the 81 character line (i.e., SC135 low). The Dot Clock will be controlled by the Q output of flip flop 503. The $\overline{Q}$ output of flip flop 503 is connected to the J input of flip flop 502. The $\overline{Q}$ output of flip flop 502 is in turn connected as the K input of flip flop 503. Referring to FIG. 6, just prior to master clock 0 (and every 3 master clocks thereafter) 503 Q is high, 502 $\overline{Q}$ is high and 503 $\overline{Q}$ is low. At master clock 0, 503 Q is forced low and 503 $\overline{Q}$ is forced high by 503 K (i.e., 502 $\overline{Q}$) being high. Since 502 J was low, 502 Q remains high. At the second master clock pulse (master clock 1) 503 Q returns high and 502 $\overline{Q}$ and 503 $\overline{Q}$ return low. At the third pulse (Master Clock 2), 503 Q and 503 $\overline{Q}$ are unchanged, since 503 K was low, while 502 $\overline{Q}$ returns high. The states of flip flops 502 and 503 are now identical to the states just prior to master clock 0. It can be seen that the 81 character dot clock falling edge will occur at every third master clock falling edge.

To ensure that the HSYNC signal is stable, the circuit is designed such that the transition from the 81 column dot clock to the 135 column dot clock or vice versa occurs at the time when both dot clocks are in the low state followed by a high state. It can be seen from FIG. 6 that this situation is present every 6 master clock cycles. The number of master clock cycles per horizontal sync period is therefore chosen to be an even multiple of 6, insuring that the handover always happens on the same master clock pulse, i.e. when the low followed by high conditions exist. This coordination of dot clock sources at the time of changeover from 81 to 135 or vice versa eliminates foreshortened or lengthened horizontal sync pulses which could result in visibly degraded displayed characters.

At initial terminal start up or after some event that interrupted the normal timing sequence, the RESET signal, normally high, is asserted low. This forces 505Q low and, since 505Q is connected to flip flops 502, 503 and 504, will force outputs 502Q, 503Q and 504Q high. When RESET is unasserted, 505Q goes high on the next master clock pulse. The initial states of flip flops 502–505 have now been set up and, on the following master clock pulse (Master Clock 0), dot clock generation begins as described above.

Gates 507 (for example, a 74S02) and 508 (for example, a 74S51)act as the selecting mechanism between the Dot Clock pulse from flip flop 504 (135 column dot clock) and flip flop 503 (81 column dot clock). The state of SC135, which is high for 135 column format, enables either input B or input D of gate 508. The output of gate 508 becomes the Dot Clock for all terminal operations during that character row.

The Dot Clock signal from gates 508 is supplied to the clocking input of clock counters 510 and 511 (for example, 74S161's). Counters 510 and 511 trigger on the rising edge of the Dot Clock pulse. As discussed earlier, the number of Dot Clock pulses in a Pipe Clock pulse may vary, for example the 81 column Pipe Clock contains 10 Dot Clock pulses while the 135 column Pipe Clock contains 9. The division of the Dot Clock pulses by 9 or 10 to yield Pipe Clock pulses is controlled by inverting the SEL_COL_135 signal from Video Control Logic 200 with gate 509 (for example, a 74S02) and using the output to vary the value preloaded into counters 510 and 511.

Figure 7:
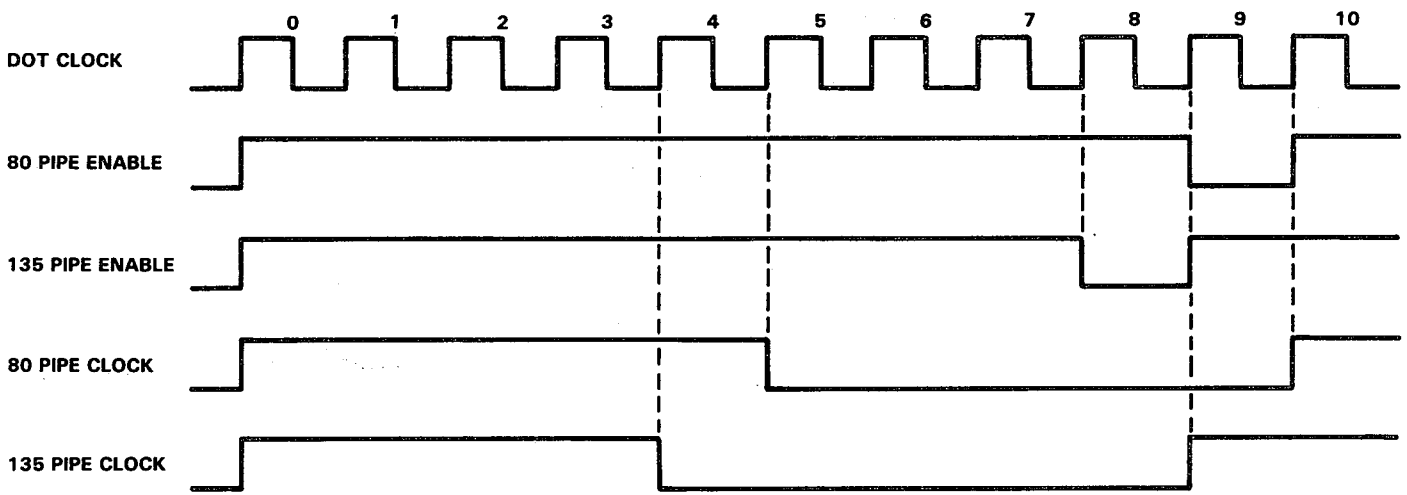
FIG. 7 is a timing diagram illustrating the operation of other portions of the Video Timing Logic of FIG. 5.

Referring to FIGS. 5 and 7, the operation of counters 510 and 511 is illustrated. In the 81 column case (i.e. SEL 135 low), counters 402 and 403 are preloaded to 11. After five Dot Clock pulses the PIPE_CLOCK output of counter 402 goes low. After four more clock pulses, the PIPE_ENABLE output of counter 403 goes low, which forces both PIPE_CLOCK and PIPE_ENABLE high at the next clock pulse. Therefore, the 81 column PIPE_CLOCK signal is high for five Dot Clock pulses and low for five Dot Clock pulses. PIPE_ENABLE is high for nine Dot Clock pulses and low for one.

The 135 column case is similar except the counters are preloaded to 12 rather than 11. The 135 column DOT CLOCK pulse will therefore be high for four Dot Clock pulses and low for five, while PIPE_CLOCK will be high for eight Dot Clock pulses and low for one.

Video Control Logic

Figure 8:
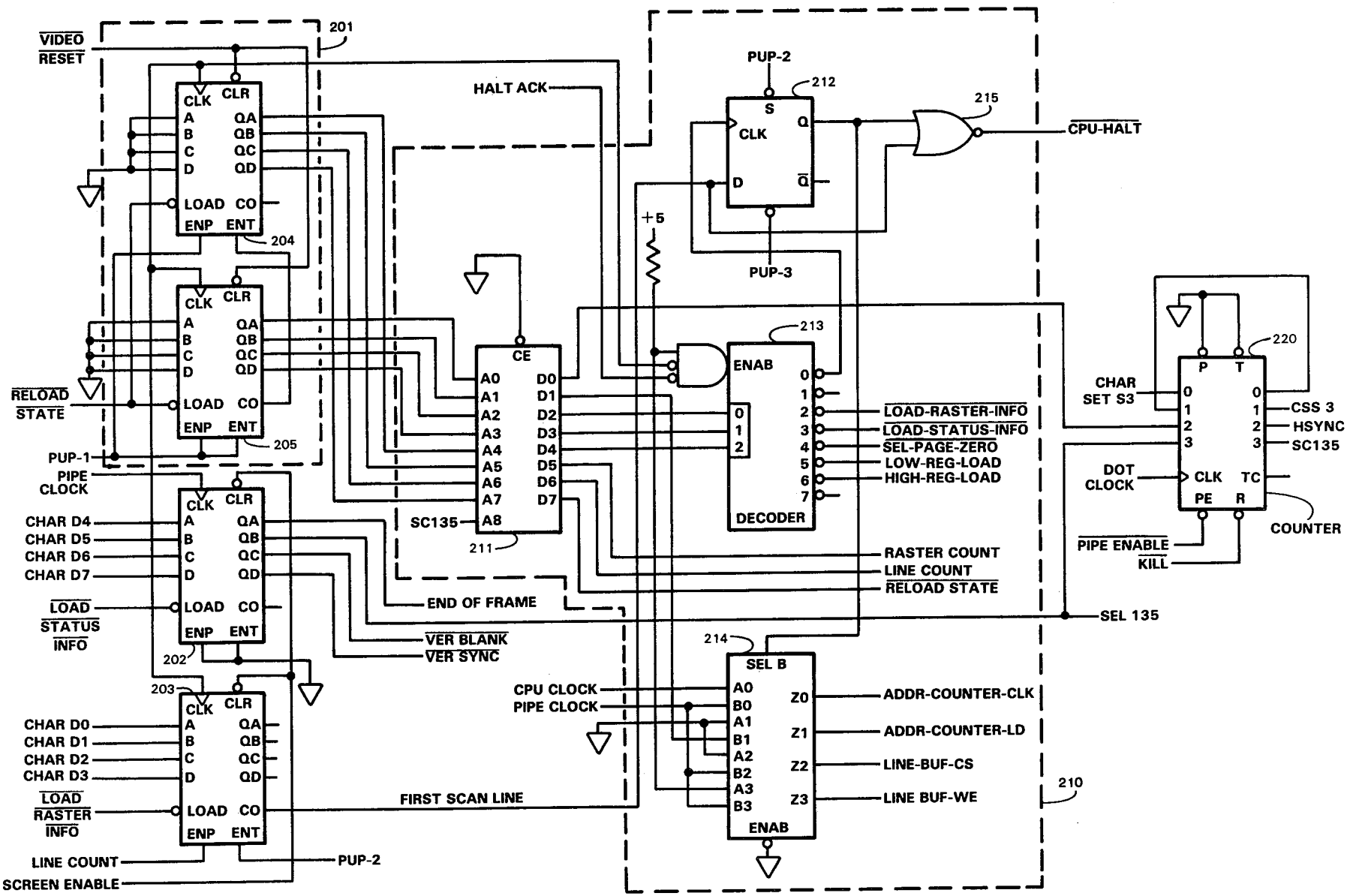
FIG. 8 is a schematic diagram of the preferred embodiment of the Video Control Logic of FIG. 2.

Referring now to FIG. 8, a detailed schematic of Video Control Logic 200 (FIG. 2) is given. State Counter 201 is seen to consist of counters 204 and 205 (for example 74LS161's). State Machine 210 is implemented as 512×8-bit PROM 211 (for example, an MMI 6349), 3-to-8 line decoder 213 (for example a 74LS138), multiplexer 214 (for example, a 74LS257), CPU Halt flip flop 212 (for example, a 74LS74) and gate 215 (for example a 74S02).

Counters 204 and 205 receive VIDEO_RESET from flip flop 505 (FIG. 5). This signal is used for initialization and clears the counter. Counters 204 and 205 also receive RELOAD_STATE from PROM 211 to restart the counters at zero at the appropriate state, depending on whether the current display mode is 81 column or 135 column. The counters are clocked by PIPE_CLOCK.

The output from the counters is supplied to PROM 211, along with signal SC135 indicating whether the display mode is 81 or 135. SC135 can be considered as a pointer to either of two 256 byte segments of PROM 211. Therefore, for each possible value from counters 204 and 205, there is a unique 8-bit byte location in PROM 211.

Figure 9:
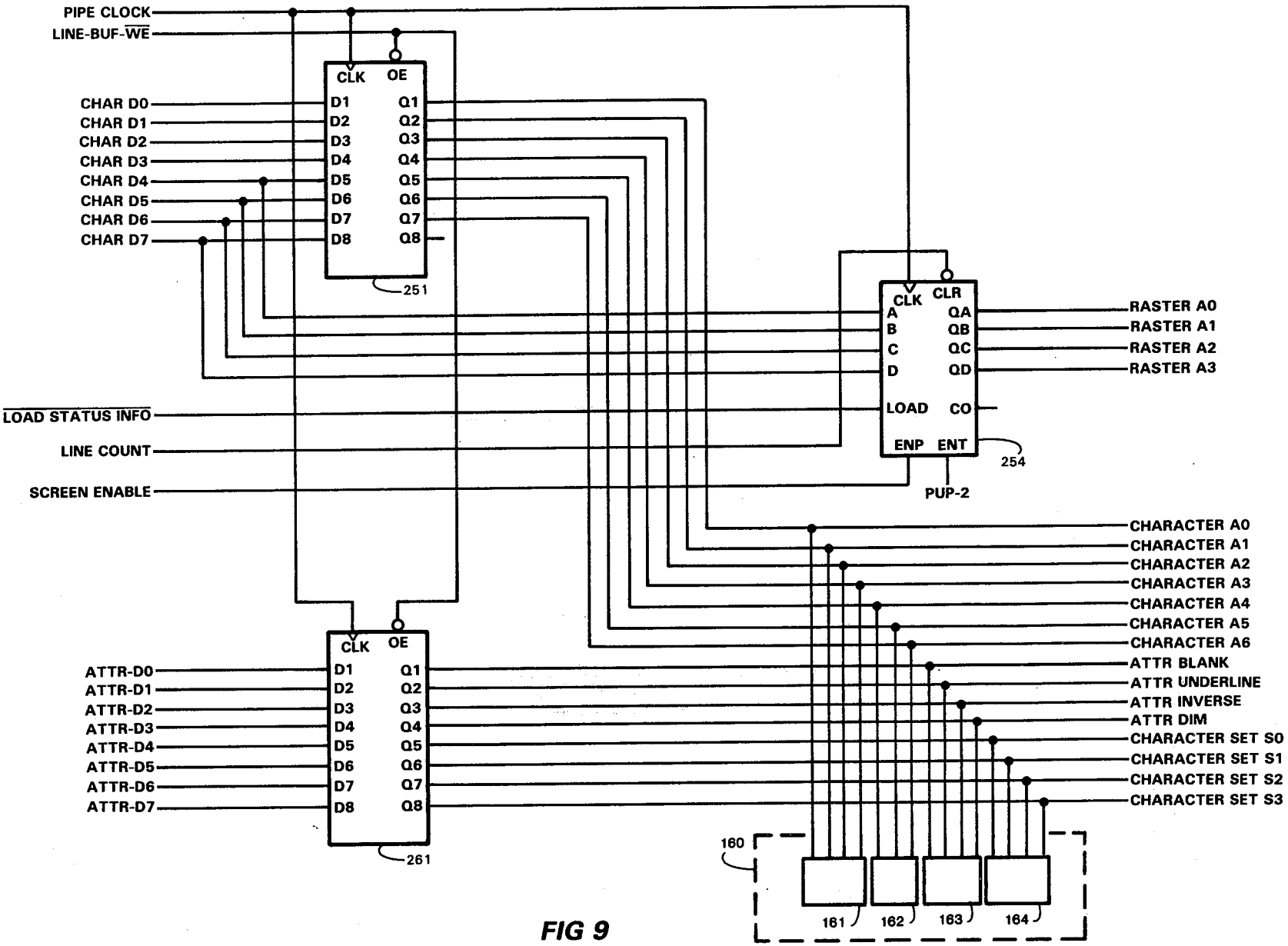
FIG. 9 is a schematic diagram of portions of the preferred embodiment of the Video Character Generation Logic of FIG. 2.
Figure 9A:
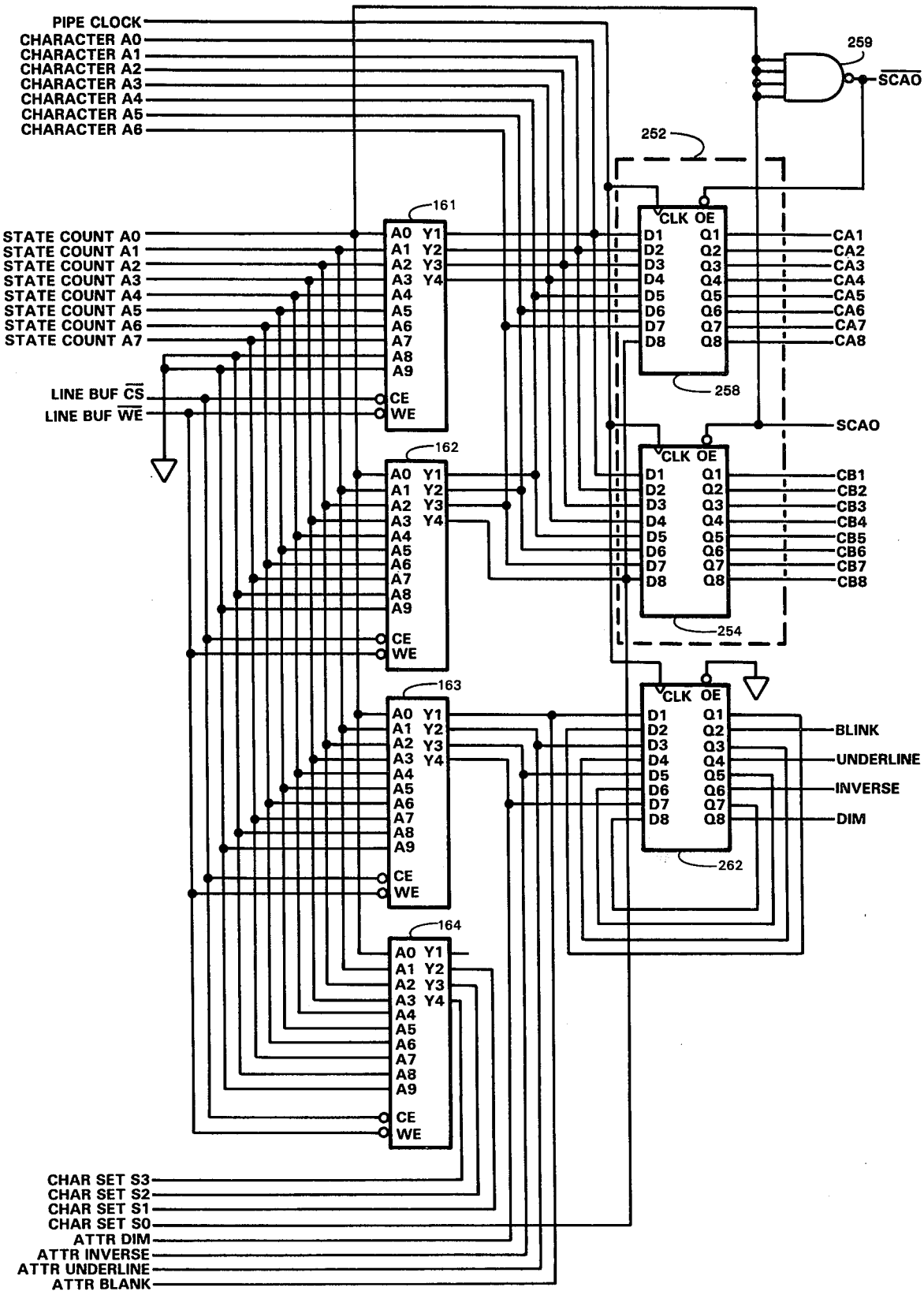
FIG. 9A is a schematic diagram of the preferred embodiment of the Line Buffers and other portions of the Video Character Generation Logic of FIG. 2.
Figure 9B:
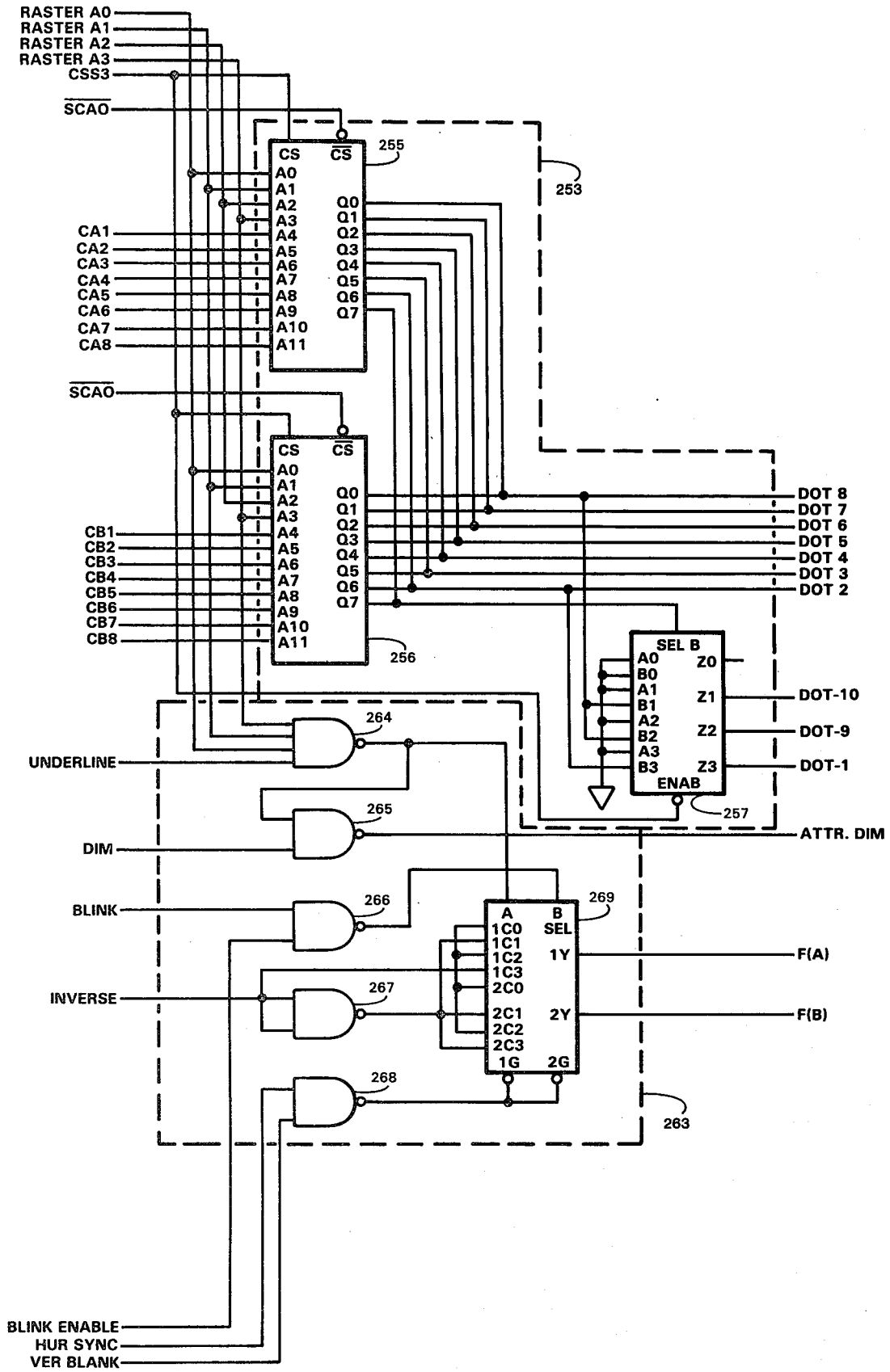
FIG. 9B is a schematic diagram of the preferred embodiment of further portions of the Video Character Generation Logic of FIG. 2.

PROM 211 output D0 is supplied to Latch 220 (for example, a 74S161) and originates the horizontal synchronization signal to the terminal monitor. Output D1 is supplied to Multiplexer 214. Outputs D2, D3 and D4 are supplied to Decoder 213. Output D5 (RASTER_COUNT) is supplied to Raster Line Counter 254 (FIG. 9) to enable counting of scan lines in the character now being displayed. Output D6 (LINE_COUNT) is supplied to Line Counter 203 (for example, a 74LS161) to enable scan line counting. Finally, output D7 (RELOAD_STATE) is supplied to State Counters 204 and 205, as discussed above.

Decoder 213 requires two enabling inputs. The first, HALT ACK, comes from CPU 100 and indicates that CPU 100 (for example, an MC6809) has relinquished control of the address and data buses to Video Control Logic 200. Since PROM 211 is always enabled, the second input, PIPE_CLOCK, is used to prevent possible false decoder outputs.

In response to the three input signals from PROM 211, Decoder 213 provides six output signals as follows:

A clocking input to CPU Halt flip flop 212;

LOAD_RASTER_INFO, supplied to Line Counter 203;

LOAD_STATUS_INFO, supplied to Status Latch 202; and

SEL_PAGE_ZERO, LOW_REG_LOAD, and HIGH_REG_LOAD, all supplied to Address Latches Logic 300.

CPU Halt flip flop 212 and gate 215 combine to generate the CPU_HALT signal. This signal, asserted when low, requests CPU 100 to relinquish control of the address and data buses. CPU 100 will respond to this request only after completing execution of the current instruction.

Because the length of time required to complete the current instruction may vary significantly, Video Control Logic 200 waits a period of time which is adequate to allow completion of execution of the longest instruction prior to taking any action in regard to the address and data buses. This ensures CPU 100 has halted.

FIRST_SCAN_LINE is received by flip flop 212 and gate 215 from Line Counter 203. Flip flop 212, clocked by an output from decoder 213, is necessary to latch the Q output of 212 high and therefore hold CPU_HALT in the low (i.e. asserted) state. This is required since Line Counter 203 will be reset and FIRST_SCAN_LINE will go low before CPU 100 should be allowed to regain bus control. Flip flop 212 holds CPU_Halt in the low state until reset by another clocking pulse from Decoder 213 under control of PROM 211.

Multiplexer 214 selects four outputs from eight available inputs based on the state of 212 Q. That is, based on whether CPU 100 or Video Control Logic 200 is controlling the data and address buses. ADDR_COUNTER_CLK is the timing pulse provided to Address Latches 301–304. If 212 Q is low, (i.e. CPU not halted) CPU_CLOCK is supplied to Latches 301–304. If 212 Q is high (i.e. CPU halted), PIPE_CLOCK is supplied. ADDR_COUNTER_LD controls loading of Address Latches 301–304. It is selected between a signal from PROM 211 if 212 Q high and a continually high signal if 212 Q low. LINE_BUF_CS controls writing of data into Line Buffers 161–164. It is selected between a continuously low signal if 212 Q is low or PIPE_CLOCK if 212 Q is high. LINE_BUF_WE also controls writing of data into Line Buffers 161–164 and is selected between a continuously high signal if 212 Q is low and PIPE_CLOCK if 212 Q is high.

Latch 220 is enabled by PIPE_ENABLE, has a reset input KILL, and is clocked at the dot clock rate. Inputs to Latch 220 are SEL 135 from Status Latch 202, a horizontal synchronization signal from PROM 211, and CHAR_SET_S3 indicating a user optional character set is being used. Output SC135, indicating character line format, is supplied to Timing Logic 400. The horizontal synchronization signal HSYNC is supplied to the monitor electronics and CSS3 is supplied to character Generation Logic 250.

Status Latch 203 (for example, a 74LS161) is clocked by PIPE_CLOCK and, when LOAD_STATUS_INFO from Decoder 213 is received, will receive the four most significant bits of the character byte then being read on Character Bus 191. These bits contain the signal indicating end of frame, display mode (i.e. 81 or 135 characters), vertical synchronization and display blanking. At the next PIPE_CLOCK pulse END_OF_FRAME is provided to CPU 100, VER_BLANK is provided to Video Character Generation Logic 250, VER_SYNC is provided to Latch 170 and the signal indicating display mode is provided to Latch 220.

Line Counter 203 is also clocked by PIPE_CLOCK and loads the four least significant bits of the character byte then being read on Character Bus 191 when LOAD_RASTER_INFO is received from Decoder 213. These four bits identify the number of scan lines of the character row to be displayed. This information, together with information from Raster Counter 254, provides the ability to accomplish smooth vertical scrolling of displayed characters. Counter 202 and Latch 203 receive clearing signal SCREEN_ENABLE from the terminal hardware.

Character Generation Logic

Referring now to FIGS. 9, 9A, 9B, and 9C, a detailed schematic of an embodiment of Character Generation Logic 250 and Line Buffers 161–164 is shown.

Character Latch 251 (for example, a 74LS374) is connected to Character Data Bus 191 and Attribute Latch 261 (for example, a 74LS374) is connected to Attribute Data Bus 193. Both Latches are clocked by PIPE_CLOCK. On the first scan line of each character row, Video Control Logic 200, which has control of the data and address buses at this time, will fill Line Buffers 161–164, via Latches 251 and 261, with the character and attribute data for that row from RAM 150. In this embodiment Line Buffers 161–164 are implemented as 1K×4 MOS RAM's (for example, 2114's). The data will be removed from Line Buffers 161–164 as required during the horizontal scan cycles needed to display the row. LINE_BUS_CS and LINE_BUF_WE, both controlled by PIPE_CLOCK during the fill period, ensure stable data addresses in the line buffers. When Line Buffers 161–164 have been filled, LINE_BUS_CS goes low to ensure the data is available in the shortest possible time and LINE_BUF_WE goes high to ensure Line Buffers 161–164 are always in the "read" state.

The state count from State Counters 204 and 205 is supplied to Line Buffers 161–164. As the state count is incremented by PIPE_CLOCK (i.e. on a character-time basis), the four output bits of Line Buffers 161–164 will present attribute and character information for the character stored in Line Buffers 161–164 corresponding to that count. Line Buffer 161 provides the four least significant character bits and Line Buffer 162 provides the four most significant character bits to Character Latches 254 and 258 (for example 74LS377's). Line Buffer 163 provides the four attribute bits to Attribute Latch 262 (for example, a 74LS377). The attribute bits indicate whether the character will be dim, inverse, underlined or blinking. The outputs of Line Buffer 164 relate to use of user optional character sets and may or may not be used in a given terminal application. Use of an optional character set is indicated to Multiplexer 256 and to Character Generators 255 and 256 by CSS3, which is supplied as an enabling input.

In this embodiment of the invention, Character Generators 255 and 256 are 4K×8 MOS ROM's (for example, 2732's). Due to speed limitations of Character Generators 255 and 256 used in this embodiment, two character latches and two character generators are used. This allows the information to be read and stored in Character Generators 255 and 256 for two character times before dot information is forwarded for display. Latch 254 and Generator 256 are enabled by the least significant bit of the state count (SCAO). SCAO is inverted by gate 259 (for example, a 74LS20) and provided as the enabling input to Latch 258 and Generator 255. Therefore, alternately, either Latch 258 and Character Generator 255 or Latch 254 and Character 256 will be enabled.

To synchronize attribute data with the character data from Generators 255 or 256, Attribute Latch 262 loops back on itself. Two PIPE_CLOCK pulses are therefore required to forward attribute data to Attribute Encoding Logic 263, shown in FIG. 9B to be constructed of gates 264–268 and 4-line Multiplexer 269 (for example, a 74LS257).

Gates 264–268 and Multiplexer 269 provide the proper attribute encoding prior to merging of attribute and character data. Gate 264 (for example, a 74LS20) "ands" UNDERLINE with 3 raster line bits from Raster Counter 342. All input conditions will be satisfied if underlining is requested and the eleventh raster line of the character row is being displayed. Gate 265 (for example, a 74LS00) prevents dimming if underlining is taking place, since the output of gate 264 will be low if all underlining conditions are met. Gate 266 (for example, a 74LS00) "ands" the BLINK signal with BLINK ENABLE. Gate 267 (for example, a 74LS20) inverts the INVERSE signal and gate 268 (for example, a 74LS20) disables Multiplexer 269 if either horizontal sync or vertical blinking is underway. Outputs F(A) and F(B) of Multiplexer 269 are therefore based on the state of INVERSE and are selected by the outputs of gates 264 and 266.

F(A) and (B) are provided to Latch 270 (for example, a 74S161), along with the ATTR_DIM and HOR_SYNC signals. Latch 270 is clocked at the dot clock rate and provides dimming information to Latch 170 (for example, a 74S195). Latch 270 also controls the output of Merging gates 280 (for example, a 74S51) based on the state of F(A) and F(B). If F(A) and F(B) are both high, all dots sent to monitor 180 are "on". If F(A) and F(B) are both low, all dots are turned "off". If F(A) is low and F(B) is high the normal character bit stream from register 272 is sent and, finally, if F(A) is high and F(B) is low, the inverse of the bit stream is sent to monitor 180.

Character Generators 255 and 256 also receive RASTER A0–A3 from Raster Counter 254 (for example, a 74LS161). These signals identify which of the twelve scan lines in the character row is currently being displayed. The character generator will then output the dot pattern to be displayed based on the particular character and scan line. As discussed earlier, the displayed character portion occupies 7 dots (2–8) in the character field which is either 9 dots wide in 135 character format or 10 dots wide in 81 character format. To yield the 9 or 10 dot signals required for each raster line character field, outputs Q0–Q6 of Character Generators 255 and 256 are used for the character itself (i.e. DOT2–DOT8), while output Q7 is routed to Multiplexer 257 (for example, a 74LS257), where it is used to control selection of the remaining required dot signals. Multiplexer 257 is enabled unless a user optional character set has been selected, indicated by CSS3 going high If CSS3 is high the outputs of multiplexer 257 are tri-stated and overridden by data on DLL bus 194. The A inputs to Multiplexer 257 are held low. Inputs B1 and B2 are connected to the DOT 8 signal from the character generators and input B3 is connected to the DOT 2 signal. If output Q7 of the character generators is low the A inputs will be selected and outputs DOT 1, DOT 9 and DOT 10 will be low. If Q7 is high, Multiplexer 257 outputs DOT 9 and DOT 10 will have the same state as DOT 8 while output DOT 1 will have the same state as DOT 2. This implementation, using standard logic components, is less expensive than implementations using non-standard ROM's having a 10 bit output or using an 8 output ROM ganged with an additional 4 output ROM, yet provides the capability for the terminal to display a solid horizontal line across the monitor screen or display the intersection of a horizontal line and a vertical line.

Figure 9C:
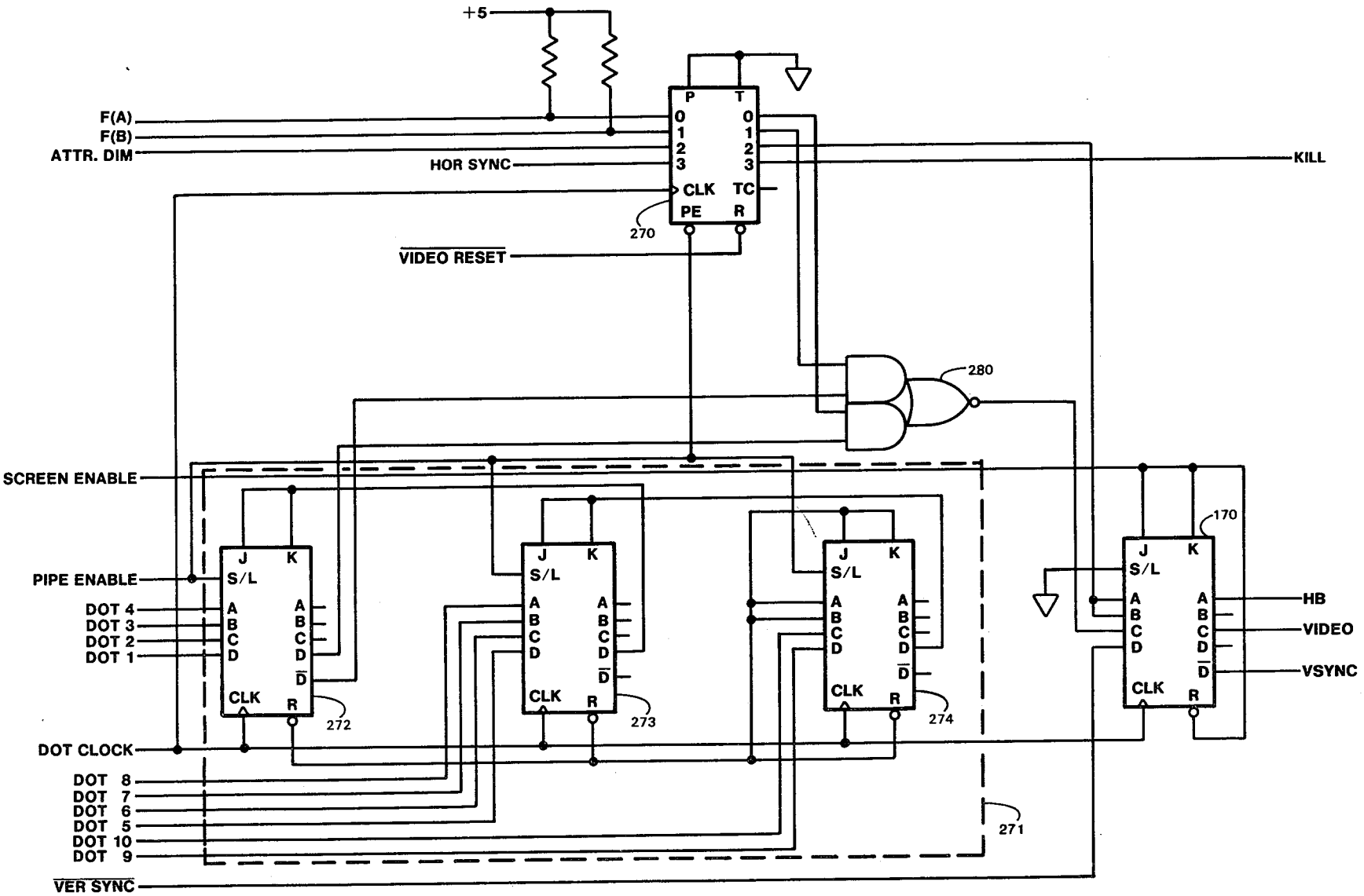
FIG. 9C is a schematic diagram of the preferred embodiment of yet other portions of the Video Character Generation Logic of FIG. 2.

The dot information is therefore provided at the Pipe Clock rate to Shift Registers 271, shown in FIG. 9C as constructed of 4 bit registers 272, 273 and 274 (for example, 74S195's). The dot information will be shifted out of these registers at the dot clock rate starting with the first dot to be displayed (i.e. Dot 1). Dots 1–4 are initially provided to Register 272, Dots 5–8 to Register 273 and Dots 9–10 to Register 274. These registers receive PIPE_ENABLE from Clock Counter 403.

Each dot and its inverse will be supplied to gate 280, where character information from register 272 and attribute information from Latch 270 are merged. The combined dot information is supplied to Latch 170, which synchronizes the dot information (VIDEO) transfer to Monitor 180 with transfer of the vertical synchronization signal and the dimming signal (HB).

Address Latches

Figure 3:
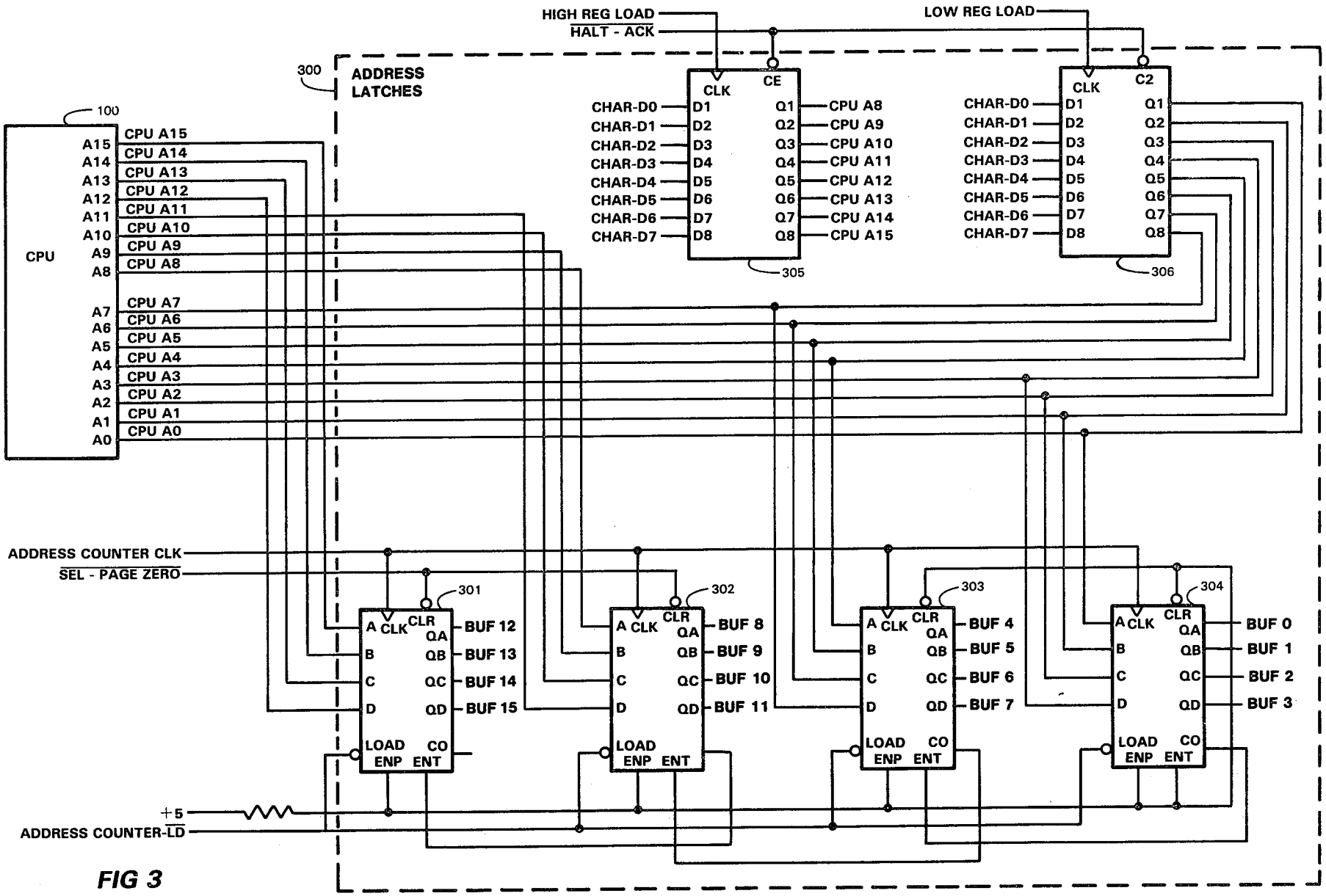
FIG. 3 is a schematic diagram of the preferred embodiment of the Address Latches of FIG. 1.

Referring to FIG. 3, a detailed schematic of an embodiment of Address Latches 300 is presented. As discussed above, Video Control Logic 200 will request CPU 100 to relinquish its control over Address Bus 195 (BUF0-BUF15) on the last scan line of each character row. Since Video Control Logic 200 does not know what operation CPU 100 is performing, it will wait long enough after generation of CPU_HALT to allow the maximum length instruction to complete execution. This removes the possibility of a contention over control of the address and data buses.

Video Control Logic provides addresses to Address Latches 301–304 (or example, 74LS161's) by means of Latches 305 and 306 (for example, 74LS374's), which are loaded from Character Bus 191 by Video Control Logic 200. Latches 305 and 306 are clocked by HIGH_REG_LOAD and LOW_REG_LOAD respectively from Decoder 213. The outputs of Latches 305 and 306 are connected as inputs to Address Latches 301–304. Latches 301–304 are clocked by PIPE_CLOCK, if CPU 100 is halted and Video Control Logic has bus control, or by CPU_CLOCK, if CPU 100 has bus control. Loading of Latches 301–304 is controlled by ADDR_COUNTER_LD from Multiplexer 214. When CPU 100 has bus control, this signal is always low (i.e. loading always enabled). SEL_PAGE_ZERO from Decoder 213 forces Latches 301 and 302 to all zeros to assure the memory space containing the RDB lists is addressed.

Row Descriptor Blocks

For purposes of illustration, assume again the typical terminal having 288 displayed scan lines with 22 horizontal scan cycles required for vertical retrace. These 288 lines are equivalent to 24 character rows of 12 scan lines each, but, because of the smooth scrolling capability discussed below, during some vertical scans the top and bottom rows in the scroll "window" will be only partially displayed. This requires CPU 100 to maintain 25 rows of character information in RAM 150.

This terminal embodiment allocates 8K bytes of RAM 150 for storage of attribute and character information. This memory space allows CPU 100 to store character and attribute information for 162 characters in RAM 150 for each of the 25 character rows.

During each vertical retrace period, CPU 100 will update and store the row information from which the display will be created during the next vertical scan. This row data (character and attribute) is organized on a row basis, rather than a screen basis. That is, each row of characters is stored in consecutive memory locations, but the rows are not arranged in any particular order. They are, instead, "linked" by means of RDB's (Row Descriptor Blocks), also assembled by CPU 100.

Each character row has associated with it one RDB consisting of five 8-bit bytes of information. The first, or Status byte contains the information about row format (81 or 135 character line), end of frame, vertical synchronization and vertical blanking. The second, or scroll, byte contains information about which scan line in the character row will be the first to be displayed and how many scan lines of the character row will be displayed. This information enables "smooth" vertical scrolling by allowing less than the entire character row to be displayed during a frame. The third and fourth bytes contain the starting address in RAM 150 of the 81 or 135 characters (depending on the format identified in the Status byte) to be displayed on that row. This information enables horizontal scrolling of the display within the 162 characters stored in RAM 150 for that row by simply changing the address in RDB bytes three and four. No change to character information in RAM 150 is required. The fifth, or Next RDB, byte is a pointer to the next RDB. That is, it contains the address of the next RDB to be used. Since the 8 bits of the Next RDB byte allow only 256 addresses, the RDB's are placed in the lowest memory locations in RAM 150. With five bytes per RDB, up to 51 possible RDBs can be used.

Advantages of RDB usage can now be clearly understood. For example, significant reductions in CPU work load and required memory speed can be realized. Since the display information is stored in RAM 150 by rows, rather than in a continuous sequence for the entire screen, the CPU is no longer required to move lengthy strings of character and attribute information for each character change. Rather, all character rows which do not require modification during a vertical retrace need not be moved in memory. Only the memory locations for the row being changed are affected.

Figure 10:
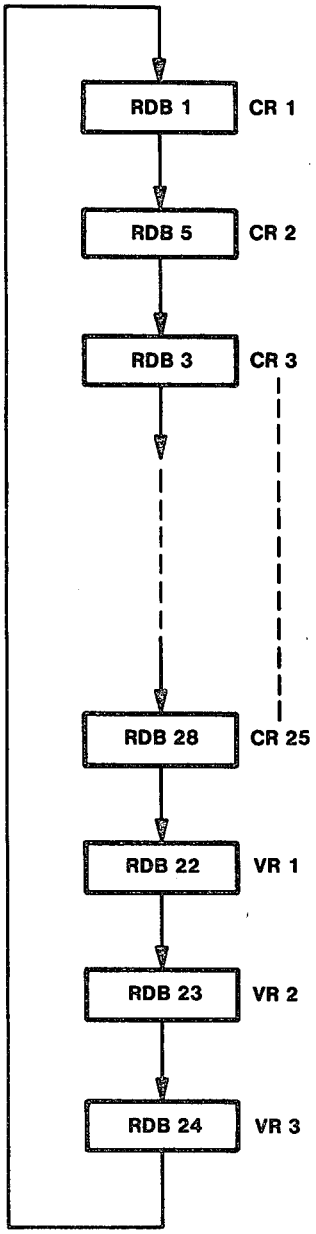
FIG. 10 is a block diagram illustrating a possible structuring of display data.
Figure 10A:
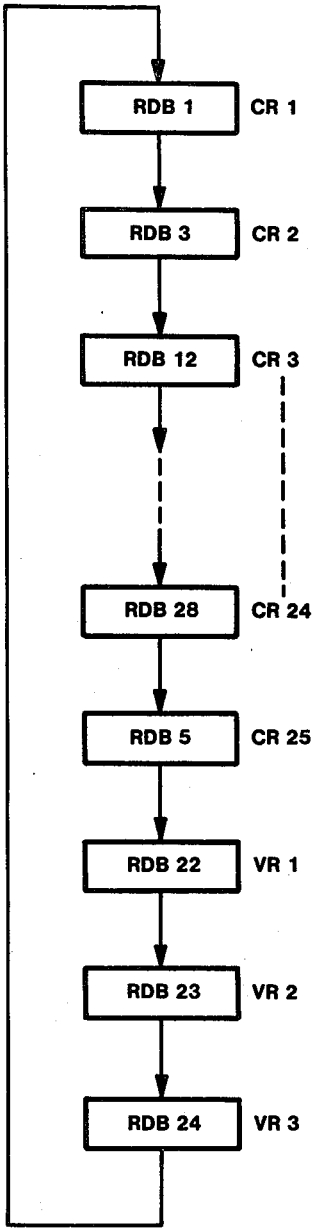
FIG. 10A is a block diagram illustrating another possible structuring of display data.

Moving displayed rows on the screen requires only that the RDB's be "relinked". That is, that the Next RDB bytes be changed. With 24 rows of character information, there will be 24 linked row RDB's. In addition, three vertical retrace RDB's are inserted after the last displayed row. These retrace RDB's do not display any information and cover a total of 22 scan lines (i.e. the retrace period). The last retrace RDB points to the RDB of the first displayed row. The complete RDB list will contain either 27 RDB's (24+3), if 24 rows are completely displayed, or 28 RDB's (25+3) if scrolling is underway and two rows are only partially displayed. A possible linking situation is shown in FIG. 10.

For simplicity of design, RDB1 is chosen to always reside in the lowest memory location. The RDB's in FIG. 10 are shown in the order of displayed character rows. That is, bytes three and four of RDB1 contain the starting memory address of displayed row 1 and the Next RDB byte (byte five in this embodiment) contains the address of RDB5. Bytes three and four of RDB5 contain the starting memory address of displayed row 2 and the Next RDB byte contains the address of RDB3. The remaining RDB's are similarly linked. RDB28 in this example is the last character row and, therefore, the Next RDB byte of RDB28 contains the address of the first of three vertical retrace RDB's. The third vertical retrace RDB points back to RDB1.

Now, assume the terminal user wishes to remove displayed row 2. Rather than the CPU having to revise and store a substantial part of the entire screen in memory, only the row associated with RDB5 and three RDB bytes need to be changed. Specifically, in this example, the Next RDB byte of RDB1 is changed to the address of RDB5, the Next RDB byte of RDB28 is changed to the address of RDB5, and the Next RDB byte of RDB5 is changed to the address of RDB22. RDB3 is now the RDB of the last character row and previous rows 3–25 have been "moved up". This situation is illustrated in FIG. 10*b*.

Also, smooth scrolling either up or down can be performed for all displayed rows on the screen or subset thereof selected by the terminal user. As stated above, the scroll byte of each RDB contains information about which of the 12 scan lines in the row will be the first to be displayed and how many of the lines will be displayed. Smooth scrolling can be accomplished by modifying the scroll bytes of the RDB's associated with the top and bottom character rows in the scroll area and relinking the RDB's as required.

Figure 11:
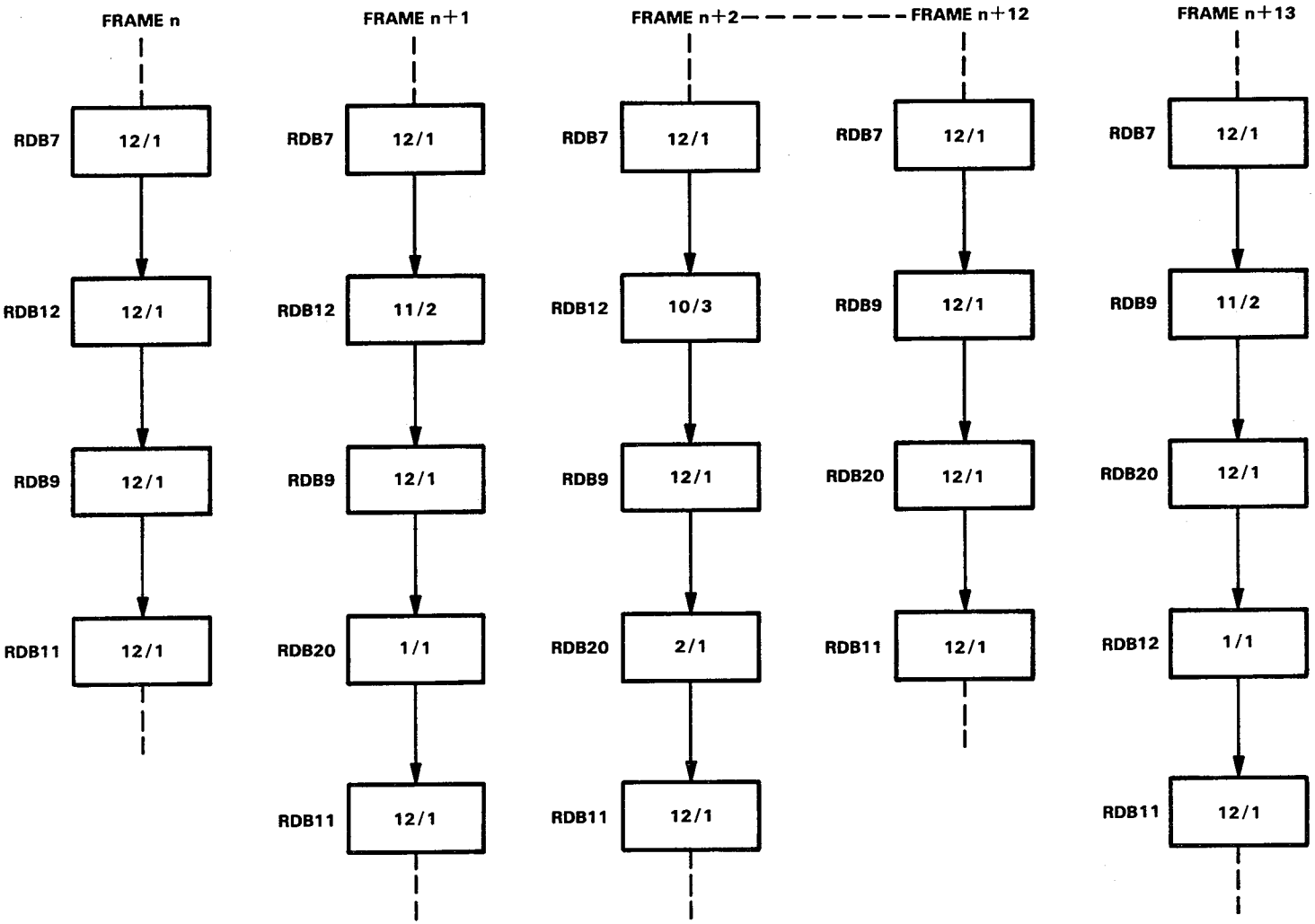
FIG. 11 is a block diagram illustrating a technique for upward vertical display scrolling.

FIG. 11 presents an illustrative example of RDB activity related to vertical scrolling at a rate of one scan line every frame. Of course, the particular RDB reference numbers and RDB linkage order shown is of no particular importance beyond this example.

The numbers inside the RDB boxes in FIG. 11 indicate the data in the scroll byte of that RDB. Specifically, the total number of scan lines of that character row to be displayed and the starting scan line within the row are given. For example, looking at RDB7 in FIG. 11, 12/1 indicates that all 12 scan lines of the character row will be displayed starting with the first (i.e. top) line.

Each of the columns in FIG. 11 shows a segment of the "list" of linked RDB's. Looking first at Frame n, assume upward vertical scrolling of the screen area now occupied by the character rows associated with RDB12 and RDB9, i.e. a scrolling space 24 scan lines high, is about to begin. During Frame n there are a total of 27 RDB's linked as described earlier. As shown for Frame n+1, however, during a scrolling operation two character rows will normally be only partially displayed, requiring that an additional RDB be linked into the RDB list. Of course, the total number of displayed scan lines in the scroll area is constant (24, in this example).

During the vertical retrace between Frame n and Frame n+1, CPU 100 will load the appropriate locations of RAM 150 with the information for the new RDB (in this example RDB 20) and with the character and attribute information for the row now associated with that RDB. In addition, the scroll byte of RDB 12 must be modified to indicate that only 11 scan lines, beginning with line 2, will be displayed and the Next RDB byte of RDB9 must be modified to point to RDB 20 instead of RDB 11. The Next RDB byte of RDB 20 will contain the address of RDB 11.

As indicated in FIG. 11, only the top line of the RDB 20 character row will be displayed during Frame n+1. The total number of displayed scan lines in the scroll area has stayed constant at 24.

During the vertical retrace between Frame n+1 and Frame n+2, no RDB relinking is required and no change to the character or attribute information stored in RAM 150 is required. Only changes to the scroll byte of the RDB of the top row currently being displayed in the scroll area (in this example, RDB12) and the RDB of the bottom now currently being displayed in the scroll area (in this example, RDB 20) are necessary. Specifically, the scroll byte of RDB12 must be modified such that only 10 scan lines, beginning with line 3, are displayed. Similarly RDB20 is modified such that now the top two scan lines of its associated character row are displayed during Frame n+2.

Modification of the scroll byte of RDB12 and RDB20 continues in this manner until the vertical retrace prior to Frame n+12. Since the RDB12 character row has now been completely scrolled "off" the screen, RDB12 is removed from the RDB linked sequence and the Next RDB byte of RDB7 is modified to point to RDB9. To the user, the display has scrolled upward by one character row. At the next vertical retrace, a new RDB (in this example, RDB 12) is linked into the list and the process described above for Frame n+1 is repeated.

At a typical monitor operating rate of 60 frames per second, this technique will result in a scrolling rate of 60 scan lines (i.e. five character rows) per second. Other scrolling rates can be achieved. For example, a 10 row per second rate can be obtained by modifying the scroll bytes by two scan lines per frame rather than one as in FIG. 11.

Figure 12:
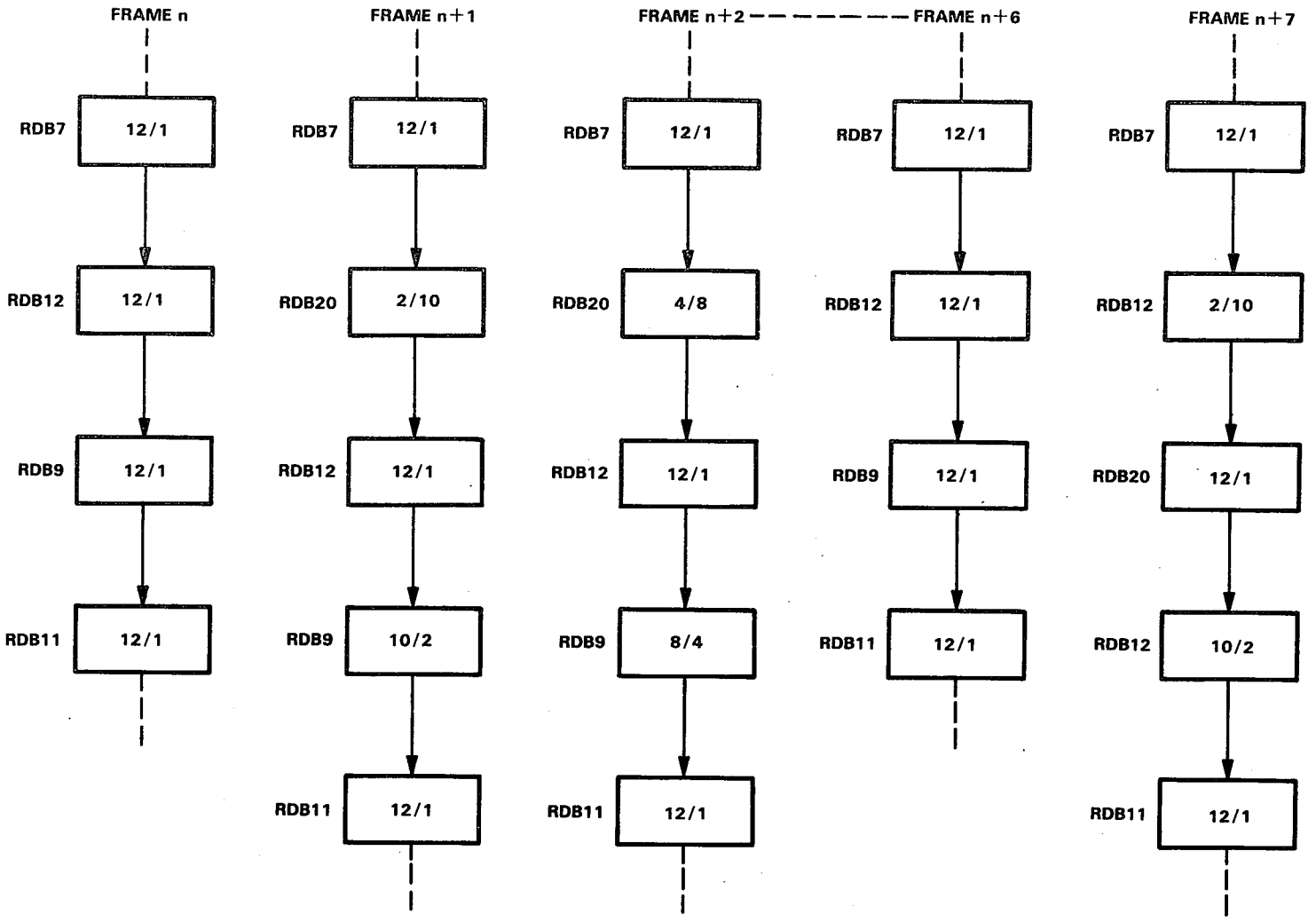
FIG. 12 is a block diagram illustrating a technique for downward vertical display scrolling.

FIG. 12 presents an illustrative example of downward scrolling at two scan lines per frame. The relinking and scroll byte modification is similar to that described above for upward scrolling except that the new RDB is linked in at above the other RDB's of the rows in the scroll area rather than after. Since scrolling is being performed at 2 scan lines per frame, the row associated with the bottom row in the scroll area (RDB9 in this example) will be completely removed from the screen in 5 frames rather than 10, as in the example of FIG. 11.

This terminal also has the capability for horizontal scrolling of displayed information. Horizontal scrolling is accomplished by changing the starting memory address (RDB bytes three and four) for that row. As mentioned earlier, RAM 150 contains 162 characters for each row, of which only an 81 or 135 character subset is displayed at any one time. Changing the contents of RDB bytes three and four causes a different subset of the 162 characters available in RAM 150 to be loaded into Line Buffers 161–164 for display. The actual character data in RAM 150 therefore need not be changed during the horizontal scrolling process.

Operation of Video Control Logic

It can be seen that the format for each row is independent of the format of any other row and is determined by the format information stored in the Status byte (byte one in this implementation) of the RDB for that row. Any combination of the display formats can, therefore, be set up by CPU 100 during vertical retrace. The actions necessary to progress from character row to character row during vertical scan are controlled by Video Control Logic 200. In summary, starting during the last scan line of each row, Video Control Logic 200, will request CPU 100 to relinquish bus control; will obtain status, raster and address information from the next RDB; will transfer the character and attribute information for the row to Line Buffers 161–164; and will release CPU 100 prior to the end of the first scan line of the following row. This sequence of events continues to repeat during vertical retrace, even though no information is being displayed. The three vertical retrace RDB's, as stated earlier, are designed to maintain proper operation and synchronization during the retrace time period until the next vertical scan begins. The particular character information in Line Buffers 161–164 during vertical retrace is irrelevant since the blanking bit of the Status byte of the three vertical retrace RDB's is set to preclude display of any information during this period.

To illustrate the coordination and operation of terminal hardware, one possible time line is given in Table 1. The entries under STATE are the hexadecimal counts in State Counters 204 and 205. The State columns show the sequence for the 81 column format and the 135 column format. As mentioned earlier, in the preferred embodiment the 81 column format has a total of 111 character times per complete horizontal scan, therefore State Counters 204 and 205 will recycle every 111 counts. Similarly, the 135 column format has a total of 185 character times per scan. The 81 column sequence starts with State 37 of the last scan line of a character row and ends with State 5C of the first scan line of the following character row. The 135 column sequence starts with State Count 5D on the last scan line of a row and concludes with 9A on the first scan line of the next row. The loading of Line Buffers 161–164 is timed such that the first scan line of the character row is being displayed synchronously with the buffer loading operation. This is necessary to ensure the information displayed on subsequent scan lines of the row match up with the first scan line.

Assume the last scan line of a character row is being displayed, necessitating the transfer of the next rows' RDB information during HSYNC.

TABLE I

| STATE 81 Char/Row | STATE 135 Char/Row | DATA TRANSFERRED AND/OR ACTION TAKEN |
|---|---|---|
| 37 | (5D) | Assert LINE COUNT (PROM 211)- Causes FIRST SCAN-LINE to be asserted by Line Counter 203 which informs flip flop 212 that the last scan line is being displayed and requests the CPU to release the address and data buses. |
| 5C | (9A) | Clock CPU Halt Flip Flop 212 - Latches request to CPU to release buses |

TABLE I-continued

| STATE 81 Char/Row | STATE 135 Char/Row | DATA TRANSFERRED AND/OR ACTION TAKEN |
|---|---|---|
| | | Assert HOR-SYNC (PROM 211) (starts Horizontal Sync period). |
| 69 | (B3) | Clock CPU Halt Flip Flop 212 - No effect at this time |
| 6A-B | (B4-5) | Select page zero of RAM 150 (locations 0000-00FF); Change Address Latches 301-304 clock from CPU-CLOCK(Q). This synchronizes memory cycles to Video Control Logic (Pipe Clock) for transfer of RDB and character and attribute information. Assert LINE-BUF-WE (Multiplexer 214). Note that data transferred into the Line Buffers 161-164 is not valid text information. This is of no consequence since the display is in the horizontal retrace period and there is special hardware to blank the video output during this period. |
| 6C | (B6) | Transfer contents of Address Latches 304 and 305, which at this time contains the next RDB Address (byte five of the previous RDB), to Address Latches 301-304. This is in preparation for transferring the RDB information to Line Counter 203 and Status Latch 202. The eight most significant bits (Address Latches 301 and 302) are not used in this transfer because all RDB elements are located in the lower 256 bytes of RAM 150. This state therefore forces the eight most significant bits to all zeroes by asserting SEL-PAGE-ZERO (Decoder 213). This allows use of a single byte for the Next RDB Pointer in the RDB list, thus conserving page zero memory. |
| 6D | (B7) | Transfer Status Information from the current RDB in RAM 150 to Status Latch 202. These four bits inform the Video Control Logic of the end of the frame (END OF FRAME), display mode (81 or 135 column), and generates the Vertical Synchronizing and Blanking signals. |
| 6E | (B8) | Assert RELOAD-STATE (PROM 211). This causes State Counters 207 and 205 to be loaded with all zeroes, which restarts Video Control Logic 200 at state zero. The transition, if required, from 81 to 135 format or from 135 to 81 format occurs now. |
| 02 | (0A) | Transfer contents of Address Latches 305 and 306 to Address Latches 301-304. This is in preparation for transferring the RDB information to Line Counter 203 and Raster Counter 254. |
| 03 | (0B) | Increment Address Latches 301-304 to point to Raster Information (byte two) in the current RDB. |
| 04 | (0C) | Transfer Raster Offset and Raster Count from the current RDB in RAM 150 to Raster Counter 254 and Line Counter 203. This information indicates which scan line of the character is first to be displayed and the number of raster lines of the character to be displayed. Line Counter 203 is given the two's complement of the line number. Note that loading Line Counter 203 unasserts FIRST SCAN-LINE. This must be done to allow CPU 100 to run when transfer of the RDB and text information is completed. |
| 05 | (0D) | Transfer eight most significant bits of text address from the current RDB in RAM 150 into the Address Latch 305. |
| 06 | (0E) | Transfer eight least significant bits of text address from the current RDB in RAM 150 into Address Latch 306. |
| 07 | (0F) | Transfer text address from Address Latches 305 and 306 into Address Latches 301-304 for transfer of text into Line Buffers 161-164. Transfer Next RDB Pointer from the current RDB in RAM 150 into Address Latch 306 for use in transferring RDB information at the end of this display row. |
| 0B | (13) | Unassert HOR-SYNC (PROM 211) (ends horizontal |

TABLE I-continued

| STATE 81 Char/Row | STATE 135 Char/Row | DATA TRANSFERRED AND/OR ACTION TAKEN |
|---|---|---|
| | | synchronizing period) |
| 0C-5B | (14–99) | Display scan line and fill Line Buffers 161–164 with text data. |
| 37 | (5D) | Assert LINE-COUNT (PROM 211). This increments the Line Counter 203. Since it is incremented before the raster line is finished, the two's complement of the actual number of raster lines to be displayed is loaded into this counter |
| 5C | (9A) | Clock CPU Halt Flip Flop 212. Since FIRST SCAN-LINE from Line Counter 203 was unasserted when the Raster Information was transferred, CPU Halt Flip Flop 212 is cleared and CPU 100 is allowed to take control of the address and data buses. Video Control Logic 200 has completed its transfer of text to Line Buffers 161–164 at this state. Note that if only one scan line of a character row is to be displayed (which is the case when smooth scrolling the last line of a row off the top of a window or smooth scrolling the first line of a character row into the bottom row of a window) FIRST-SCAN LINE will be asserted when the Line Counter 203 is clocked in state 37 (5D) by the assertion of LINE COUNT. This is necessary because Video Control Logic 200 must transfer the next row's RDB and text information on this scan line and CPU 100 must be kept off the address and data buses during this transfer. |

Video Control Logic 200 has transferred the linked list RDB information from RAM 150 to Line Counter 203, Status Latch 202 and Raster Counter 254 and the text information to Line Buffers 161–164. As explained, the first scan line of the character row was displayed while the text data was being loaded in Line Buffers 161–164. Counters 204 and 205 will now continue to count up and be reset to zero and the remaining scan lines of the character row will be displayed. Based on information from the Scroll byte of the RDB for the row, Line Counter 203 will count the number of scan lines which have been displayed and indicate when display of the last scan line of the row is underway. The process shown in Table I will then repeat.

The invention may be embodied in yet other specific forms without departing from the spirit or essential characteristics thereof. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

We claim:

1. In a raster scan CRT display terminal, the method of providing a dot clock signal and character clock signal of variable frequency to the display logic of said terminal whereby multiple character sizes and densities may be displayed during the same frame, said method comprising the steps of:

providing a first dot clock signal;

providing a second dot clock signal having a frequency different from said first dot clock signal;

providing a character rate signal indicating which of said dot clock signals is to be provided to said display logic during the character row;

if said character rate signal is in a first state, generating said character clock signal responsive to a first plurality of pulses of said first dot clock signal and providing said character clock signal and said first dot clock signal to said display logic during display of said character row;

if said character rate signal is in a second state, generating said character clock signal responsive to a second plurality of pulses of said second dot clock signal and providing said second dot clock signal and said character clock signal to said display logic during display of said character row; and repeating the above steps for each character row.

2. Apparatus for generating a character clock signal in a raster scan CRT display terminal comprising:

means for supplying a plurality of dot clock signals, each one of said dot clock signals having a frequency different from the others;

means for supplying a character rate signal indicating the number of characters per row in the character row being displayed and the number of dots in each character of said row, said character rate signal being capable of being in any one of a like plurality of states, each of said states being associated with a different one of said dot clock signals;

means, responsive to said character rate signal, for selecting from said plurality of dot clock signals the one of said dot clock signals associated with the state of said character rate signal; and means, responsive to said selected dot clock signal and to said character rate signal, for generating the character clock signal for the display row.

3. The apparatus of claim 1, wherein said means for generating the character clock signal comprises counter means preloaded in response to said character rate signal such that said character clock signal is generated responsive to a first plurality of pulses of a first dot clock signal when said character rate signal is in a first state and responsive to a second plurality of pulses of a second dot clock signal when said character rate signal is in a second state, said first plurality being diffeent from said second plurality.

* * * * *